US005540564A

United States Patent [19]

Klopfer

[11] Patent Number: 5,540,564

[45] Date of Patent: Jul. 30, 1996

[54] ROTARY DISTRIBUTOR TYPE FUEL INJECTION PUMP

[75] Inventor: Kenneth H. Klopfer, East Hartland, Conn.

[73] Assignee: Stanadyne Automotive Corp., Windsor, Conn.

[21] Appl. No.: 152,320

[22] Filed: Nov. 12, 1993

[51] Int. Cl.[6] ..... F02M 39/00; F04B 19/02

[52] U.S. Cl. ..... 417/273; 417/462; 123/506; 251/129.16

[58] Field of Search ..... 417/462, 273; 123/450, 506; 251/129.16

[56] References Cited

U.S. PATENT DOCUMENTS

| | | | |
|---|---|---|---|
| 4,909,447 | 3/1990 | Gallup et al. | 251/129.16 |
| 4,941,447 | 7/1990 | Mannhardt | 251/129.16 |
| 5,054,691 | 10/1991 | Huang et al. | 251/129.16 |
| 5,103,792 | 4/1992 | Winkler et al. | 123/506 |
| 5,215,449 | 6/1993 | Djordjevic . | |
| 5,228,844 | 7/1993 | Klopfer et al. . | |

*Primary Examiner*—Richard A. Bertsch

*Assistant Examiner*—William Wicker

*Attorney, Agent, or Firm*—Chilton, Alix & Van Kirk

[57] ABSTRACT

A rotary distributor fuel injection pump with a drive shaft coupled to a pump rotor by a radially offset and axially extending drive pin with a cylindrical head received within a radial slot in the rotor; a coaxial throughbore in the rotor providing a valve bore; a valve member in the valve bore axially shiftable to an open position by a compression spring; an electromagnet with an armature plate fixed to one end of the valve member and a stator operable, when energized, to axially shift the valve member to its closed position; a stop plate on the outer end of the rotor having an outer end face engageable by the armature plate, the end face having a plurality of lands and grooves to hydraulically dampen the axial movement of the valve member to its open position when the stator is deenergized; the armature plate having a hub received within an opening in the stop plate to couple the armature plate and valve member to the rotor; an annular thrust washer and needle bearing between the rotor and a distributor head; the distributor head having a rotor support sleeve with an inner annular cantilever section thermally coupled to the rotor; the rotor having distributor and balancing bores, each with an inlet port equidistant between he radial axes of adjacent pumping plunger bores.

12 Claims, 4 Drawing Sheets

ROTARY DISTRIBUTOR TYPE FUEL INJECTION PUMP

BACKGROUND AND SUMMARY OF THE INVENTION

The present invention relates to fuel injection pumps of the type having a pump rotor with a pumping chamber with one or more radially extending pumping plunger bores, a pumping plunger mounted in each plunger bore, annular cam means surrounding the pump rotor for reciprocating the pumping plungers for supplying intake charges of fuel to the pumping chamber and periodically delivering charges of fuel from the pumping chamber at high pressure for fuel injection, and a distributor head with a plurality of distributor outlets, the pump rotor being rotatably mounted within the distributor head and forming a distributor rotor with one or more distributor ports for distributing the high pressure charges of fuel to the plurality of distributor outlets in sequence (such fuel injection pumps being referred to herein as "Rotary Distributor Type Fuel Injection Pumps").

The high pressures within such Rotary Distributor Type Fuel Injection Pumps present certain operating problems as follows:

(a) a large axial force on the rotor thrust bearing causes galling and eventually mechanical failure of the thrust bearing; and (b) high pressure pulsations subject certain portions of the pump rotor to a large cyclical stress, resulting in crack initiation, crack propagation and eventually pump rotor failure.

Additionally, because the fuel charges are distributed at high pressure, the relatively rotating surfaces of the distributor head and distributor rotor are required to have a very precise rotational fit (for example, a diametral clearance of 80–100 millionths of an inch) to ensure adequate sealing and lubrication. The precise rotational fit presents certain operating problems as follows:

(a) during pump operation, particularly at high speed and during rapid acceleration, a substantial amount of heat is generated by the thin layer of fuel lubricant between the relatively rotating surfaces of the distributor rotor and distributor head;

(b) adequate lubrication of the relatively rotating surfaces is difficult to achieve at high speed and high temperature, particularly with low viscosity fuels such as gasoline and methanol; and (c) the thermal expansion of the outer diameter of the distributor rotor and inner diameter of the distributor head must occur at approximately the same rate throughout the full range of operation of the pump and particularly during cold starting and rapid acceleration; otherwise, the resulting unequal thermal expansion of the parts will cause inadequate lubrication and rotor seizure.

A principal aim of the present invention is to provide a new and improved Rotary Distributor Type Fuel Injection Pump which alleviates the above described operating problems presented by the high pressures within the pump and the precise rotational fit between the distributor head and distributor rotor.

Another aim of the present invention is to provide in a Rotary Distributor Type Fuel Injection Pump of the type having a valve member coaxially mounted within the pump rotor, a new and improved valve operating mechanism which provides one or more of the following advantages:

(a) high speed electromagnetic operation of the valve member;

(b) a precise open limit position of the valve member;

(c) controlled spring actuation of the valve member to prevent valve member bounce;

(d) improved valve responsiveness; and (e) low valve wear and long useful valve life.

In accordance with another aim of the present invention, a new and improved Rotary Distributor Type Fuel Injection Pump is provided which (a) can deliver high pressure charges of fuel from the pumping chamber at 12,000 psi and higher; (b) can be used with high speed engines; and (c) can be electrically controlled to precisely regulate the size and timing of the injected fuel charge.

Other objects will be in part obvious and in part pointed out more in detail hereinafter.

A better understanding of the invention will be obtained from the following detailed description and accompanying drawings of an illustrative application of the invention.

DESCRIPTION OF PREFERRED EMBODIMENT

Figure 1:
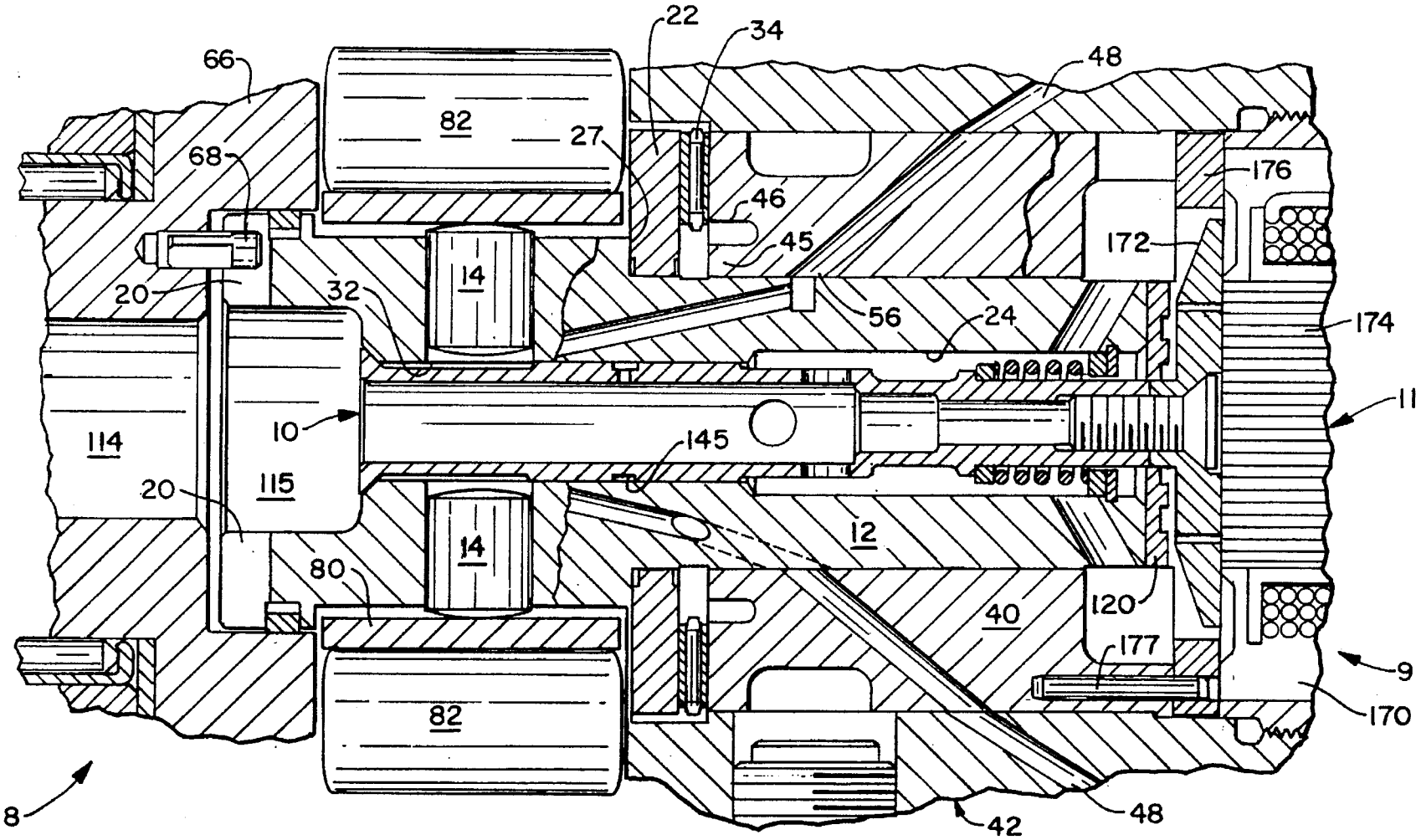
FIG. 1 is a longitudinal section view, partly broken away and partly in section, of a fuel injection pump incorporating an embodiment of the present invention, showing a poppet valve of the pump in its closed position.
Figure 2:
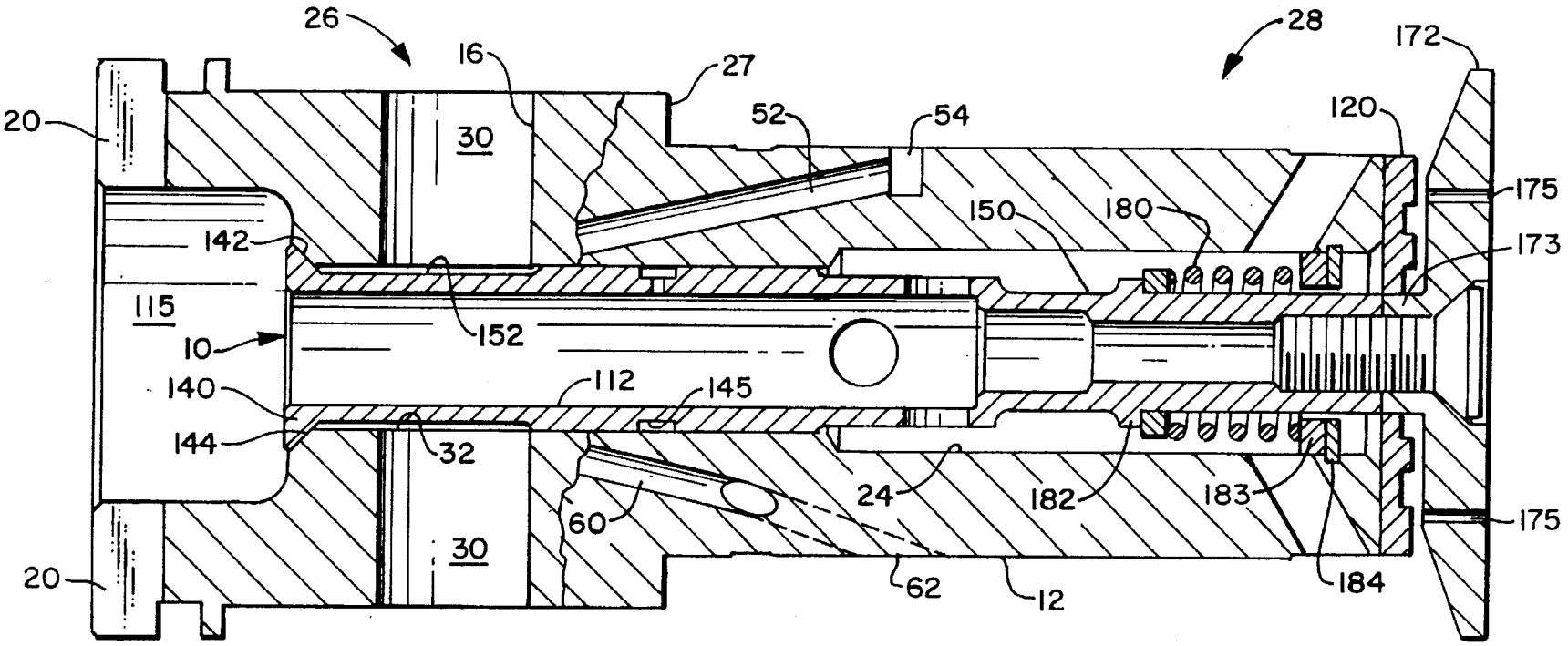
FIG. 2 is an enlarged, longitudinal section view, partly broken away and partly in section, of a rotor subassembly of the fuel injection pump, showing the poppet valve in its closed position.

In the drawings, the same numerals are used to identify the same or like functioning parts or components. FIGS. 1–7 show an exemplary fuel injection pump 8 incorporating an embodiment of the present invention. The pump 8 has an electrical control valve 9 for regulating the size and timing of each injected charge. The control valve 9 is a bidirectional flow valve having an axially shiftable poppet valve member 10, an electromagnet 11 for shifting the poppet valve 10 to its closed position (shown in FIGS. 1 and 2) and a compression spring 180 for shifting the poppet valve 10 to its open position when the electromagnet 11 is deenergized.

The pump 8 is a Rotary Distributor Type Fuel Injection Pump and may be identical to the pump described in U.S. Pat. No. 5,228,844, dated Jul. 20, 1993, and entitled "Rotary Distributor Type Fuel Injection Pump", except as otherwise disclosed herein Thus, U.S. Pat. No. 5,228,844, which is incorporated herein by reference, should be referred to for any details of the pump not disclosed herein.

Figure 7:
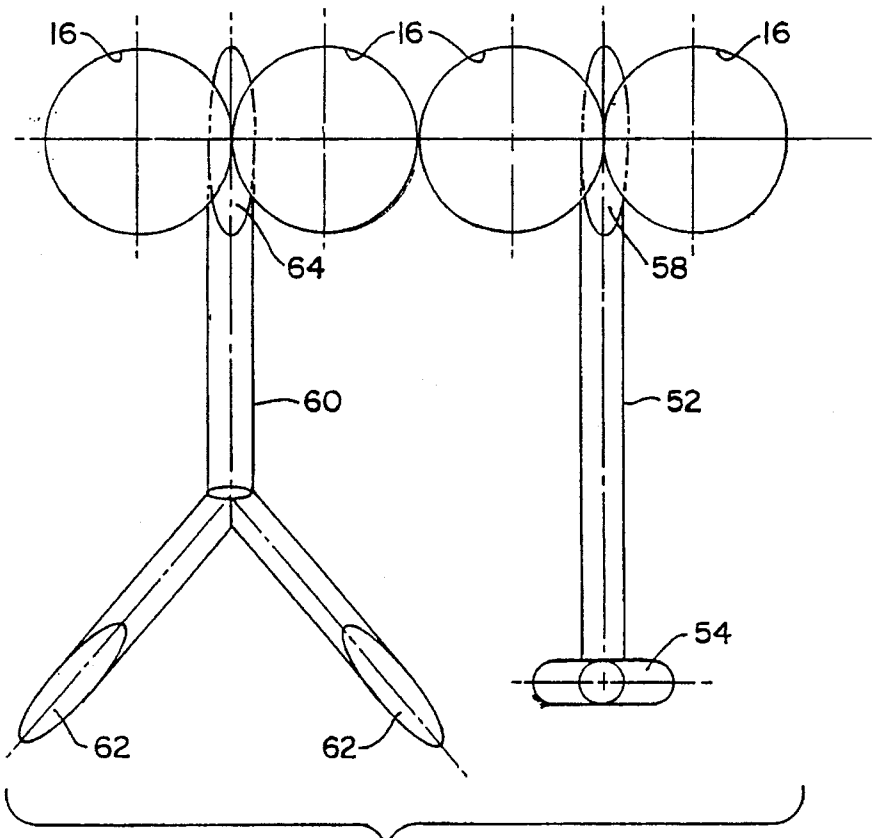
FIG. 7 is an enlarged layout view, viewed from the axis of the pump rotor, showing the relative orientation of distributor and balancing bores in the rotor and their respective ports and four pumping plunger bores of the pump.

The exemplary pump 8 is designed for use with a four cylinder engine. The pump 8 has an elongated pump rotor 12 which is constructed in the form of a single thick sleeve having a stepped, generally cylindrical, outer surface and a stepped coaxial throughbore 24. The throughbore 24 provides a central, coaxial valve bore 32 for the poppet valve 10. The pump rotor 12 forms an enlarged pump body 26 at its inner end and a reduced, elongated distributor rotor 28 at its outer end. The pump body 26 has a pumping chamber 30 formed by an annular arrangement of four equiangularly spaced radial bores 16. A pumping plunger 14 is mounted in each bore 16. Each bore 16 extends radially inwardly from the outer surface of the pump body 26 to the central valve bore 32. The four plunger bores 16 have the same diameter and have radial axes in the same transverse plane. Thus, the pumping chamber 30 formed by the transverse bank of four plunger bores 16 is provided by a transverse section of the pump body 26 lying between two transverse planes on opposite sides of and tangential to each of the four plunger bores 16. The diameter of the four plunger bores 16 and the diameter of the central valve bore 32 are established so that the inner ends of adjacent plunger bores 16 are adjacent to and preferably tangential to each other as shown in FIG. 7.

The distributor rotor 28 is rotatably mounted within an inner support sleeve 40 of a distributor head 42. The distributor rotor 28 has a very precise rotational fit (e.g., a diametral clearance of 80–100 millionths of an inch) within the distributor head bore to ensure adequate sealing and lubrication. The rotor 12 has a relatively short, inclined distributor bore 52 leading to a peripheral distributor port 54. The distributor port 54 rotates into registry with four equiangularly spaced outlet ports 56 in the distributor head sleeve 40 to distribute the high pressure charges of fuel to four distributor outlets 48 in the distributor head 42 in sequence. If desired, a relatively short, inclined balancing bore 60 is also provided in the rotor 12. The balancing bore 60 is preferably generally Y-shaped, as shown in FIG. 7, and has a pair of peripheral balancing ports 62 which are sized and circumferentially spaced from the distributor port 54 to balance the lateral hydraulic forces on the rotor 28. Also, the balancing ports 62 are circumferentially located to avoid registration with the outlet ports 56 during the inward pumping strokes of the plungers 14. The distributor bore 52 and the inner or center leg of the Y-shaped balancing bore 60 are drilled from the inner end of the throughbore 24.

A pump drive shaft 66 is mounted in coaxial alignment with and adjacent to the pump rotor 12. The pump rotor 12 is keyed to the drive shaft 66 by a radially offset, axially extending, drive pin 68. The drive pin 68 has a shank (with three equiangularly spaced, axially extending flats) press fit into an axial bore in the drive shaft 66 and an outer cylindrical head received, without play, within a diametral slot 20 in the pump rotor 12. The pump rotor 12 is thereby positively coupled to the drive shaft 66 for rotation by the drive shaft 66. The drive shaft 66 has an enlarged, generally annular, inner end providing a roller shoe support cage 76. The cage 76 has four equiangularly spaced radial slots 78 aligned with the four pumping plungers 14. A roller shoe 80 is slidably mounted in each slot 78 for engagement with the corresponding plunger 14. A plunger actuating roller 82 is supported by each shoe 80 for engagement with an internal cam 88 of a cam ring 86 surrounding the cage 76. The cam 88 has four equiangularly spaced cam lobes engageable by the plunger actuating rollers 82 for periodically camming the plungers 14 inwardly together during rotation of the pump rotor 12.

The poppet valve 10 has an enlarged annular sealing head 140 at its inner end. The sealing head 140 has an annular, frustoconical face 142 engageable with an annular, frustoconical valve seat 144 on the pump rotor 12. Fuel is supplied to a coaxial accumulator bore 114 in the drive shaft 66 via a coaxial bore 112 in the poppet valve 10. The accumulator chamber 114 and a central coaxial fuel chamber 115 within the inner end of the pump rotor 12 together provide a fuel supply chamber for supplying fuel to the pumping chamber 30 and receiving fuel spilled from the pumping chamber 30. During each intake stroke, while the poppet valve 10 is open, fuel is supplied to the pumping chamber 30 via a peripheral annulus 152 in the poppet valve 10. During each pumping stroke, after the poppet valve 10 is reopened, fuel is spilled from the pumping chamber 30 via the peripheral annulus 152.

The poppet valve 10 is opened before each outward intake stroke of the pumping plungers 14. During the first part of the intake stroke, fuel is supplied under pressure to the pumping chamber 30 to force the plungers 14 outwardly. The poppet valve 10 is timely closed by energizing the valve electromagnet 11. The amount of fuel delivered to the pumping chamber 30 before the poppet valve is closed is determined by the cam profile. The fuel pressure (e.g., 10 psi) in the pump housing cavity opposes the outward movement of the plungers 14 to help prevent plunger overtravel after the poppet valve 10 is closed.

The poppet valve 10 remains closed until the end of the following high pressure pumping phase. During that pumping phase, the plungers 14 are actuated inwardly together to deliver a charge of fuel at high pressure from the high pressure chamber formed by the pumping chamber 30 and the peripheral annulus or chamber 152 in the poppet valve 10. The electromagnet 11 is normally deenergized before the end of the pumping stroke to open the poppet valve 10 and spill fuel from the pumping chamber 30 and thereby terminate the fuel injection event.

A stator 170 of the electromagnet 11 is mounted on the distributor head 42 coaxially aligned with the poppet valve 10. A generally flat circular armature plate 172 is fixed onto the outer end of the poppet valve stem 150 by a threaded fastener. The transverse armature plate 172 is mounted adjacent to the circular pole face of an E-shaped stator core 174 to be attracted by the stator 170, when energized, to pull the poppet valve 10 to its closed position against the bias of the compression spring 180. An annular shim 176 surrounding the armature plate 172 is provided between the stator 170 and sleeve 40 to establish a predetermined gap between the flat outer end face of the armature plate 172 and the opposed flat pole face of the stator 170 when the poppet valve 10 is in its fully open position. One or more locating pins 177 are employed for positioning the annular shim 176 on the outer axial end face of the sleeve 40.

The coil compression spring 180 is mounted on the valve stem 150, at the outer end of the poppet valve 10, between an inner end washer engaging a valve stem shoulder 182 and an outer end washer 183 engaging a retaining ring 184 mounted within an internal annulus in the outer end of the throughbore 24. The compression spring 180 biases the poppet valve 10 (e.g., with a force of 10 pounds) to rapidly open the poppet valve 10 when the stator 170 is deenergized.

A valve stop plate 120 is mounted between the armature plate 172 and the outer axial end face of the distributor rotor 28. The outer end face of the stop plate 120 is engaged by the inner flat end face of the armature plate to establish the open limit position of the poppet valve 10. The stop plate 120 serves as a shim for accurately establishing the open position of the poppet valve 10. In the alternative, the stop plate 120 is employed in combination with a separate shim (not shown) mounted between the stop plate 120 and the outer axial end face of the distributor rotor 28.

Figure 3:
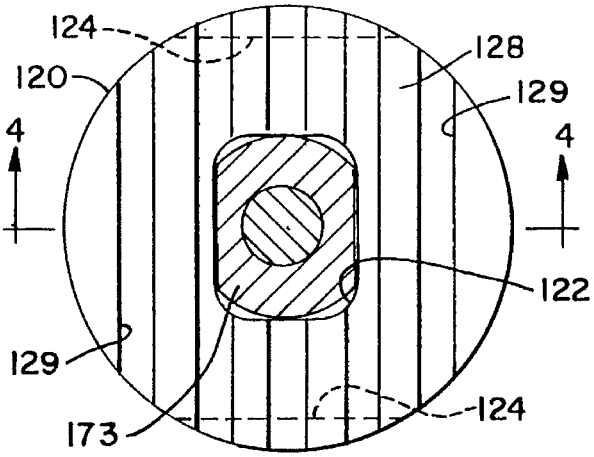
FIG. 3 is a transverse section view, partly in section, of the rotor subassembly, showing the outer axial end face of a valve stop plate of the rotor subassembly.
Figure 4:
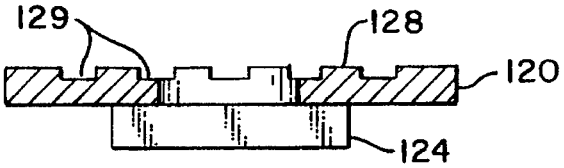
FIG. 4 is a section view, partly in section, of the stop plate, taken substantially along line 4—4 of FIG. 3.
Figure 5:
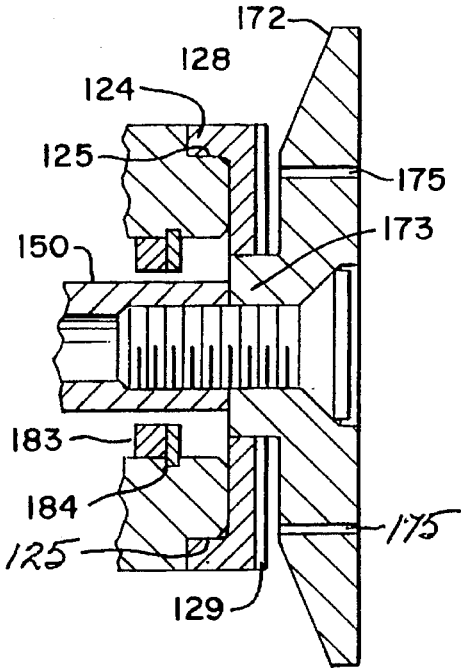
FIG. 5 is a partial longitudinal section view, partly broken away and partly in section, showing the outer axial end of the rotor subassembly.
Figure 6:
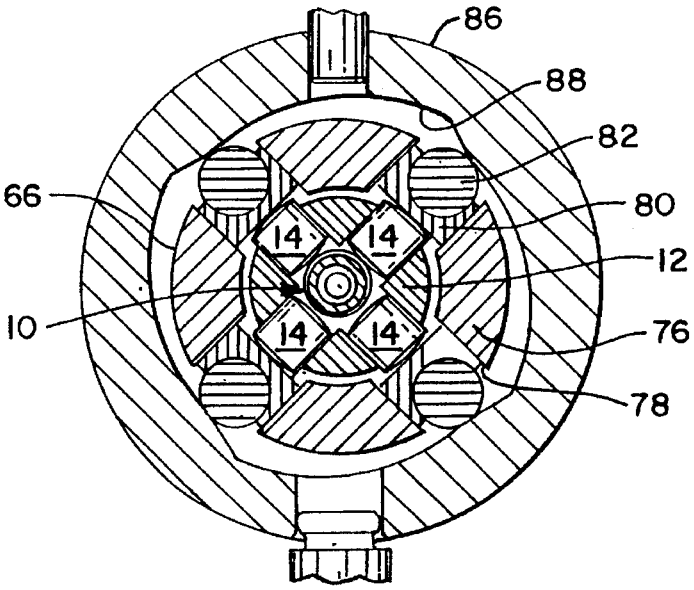
FIG. 6 is a reduced, partial transverse section view, partly broken away and partly in section, of the fuel injection pump, showing a pumping plunger section of the pump.

The poppet valve 10 and armature plate 172 are keyed to the distributor rotor 28 by the stop plate 120. The stop plate 120 has a generally rectangular opening 122 that receives an inner hub 173 of the armature plate 172. Referring to FIG. 3, the stop plate 120 and hub 173 are loosely keyed together by a pair of opposed, parallel side flats on the hub 173 and a pair of parallel flat edges on opposite sides of the stop plate opening 122. Referring to FIG. 5, the stop plate 120 has a pair of outer, axially projecting tabs or flanges 124 with opposed parallel faces that engage diametrically opposed flats 125 on the outer end of the distributor rotor 28. The poppet valve 10, armature plate 172 and stop plate 120 are thereby positively coupled to the rotor 12 for rotation by the rotor 12.

In the prior art design shown in U.S. Pat. No. 5,228,844, the poppet valve 10 can bounce off the valve stop when the poppet valve 10 is opened by its actuating spring, sometimes causing the poppet valve 10 to momentarily reseat. In the present invention, the valve stop 120 serves as a hydraulic damper plate as the armature plate 172 approaches engagement with the valve stop plate 120. For that purpose, the outer face of the valve stop 120 has a plurality of parallel grooves 129 and intermediate lands 128. The grooves 129 and lands 128 are sized to dampen or cushion the poppet valve 10 during the last 0.001 to 0.0015 inch of opening movement of the valve 10 before the armature plate 172 engages the stop plate 120. In the shown embodiment, except for the two outermost lands 128, each of the lands 128 (and each of the intermediate grooves 129) has a width of 0.062 inch (or approximately one-sixteenth inch). Also, the armature plate 172 has a number of vent holes 175. The vent holes 175 and grooves 129 in the stop plate 120 facilitate fuel flow into and out of the gap between the plates 172, 210 to facilitate engagement and separation of the valve stop 120 and armature 172.

A thrust washer 22 and thrust bearing 34 are interposed between an axially outwardly facing end shoulder 27 of the pump body 26 and the opposed inner axial end face of the distributor head sleeve 40. Prior thrust bearings like that shown in U.S. Pat. No. 5,228,844 used fuel as a lubricant to support the axial force on the rotor 12 produced by the system pressure at the inner end of the rotor 12. In such prior art designs the thrust bearing load was not adequately supported by the fuel lubricant and such that surface galling of the opposed bearing faces occurred. In the subject design, the needle thrust bearing 34 carries the thrust load produced by the system pressure to prevent such mechanical failures. The thrust washer 22 may be keyed to the pump rotor 12, if desired.

The periodic compression of fuel in the pumping chamber 30, valve annulus 152, distributor bore 52 and balancing bore 60 generates a great amount of heat. The rate of heat generation is dependent on the pump speed, pumping pressure and pumping stroke. The pumping chamber section of the rotor 12 generates the greatest amount of heat. A rapid change in the rate of heat generation can cause temperature gradients in the pump rotor 12 and distributor head 42. The temperature gradients are the greatest within the pump body 26 and within the adjacent inner axial end of the distributor rotor 28 and sleeve 40. Thus, the most critical section of the precise rotational fit of the distributor rotor 28 within the sleeve 40 is the section closest to the pump body 26. When the distributor rotor 28 is hotter than sleeve 40, the diametral clearance between those parts can be reduced sufficiently to prevent effective lubrication and cause rotor seizure. The temperature of the distributor rotor 28 and sleeve 40 can vary because of their different masses and the different rates of thermal conductivity within those parts.

In accordance with the present invention, an isolation annulus 46 is provided in the inner axial end face of the sleeve 40 to thermally isolate, in part, an inner cantilever end section 45 of the sleeve from the rest of the sleeve 40 and thereby improve the thermal coupling between the cantilever end section 45 and the corresponding section of the rotor 12. This allows the cantilever end section 45 to react to thermal transients at approximately the same rate as the corresponding section of the distributor rotor 28, thereby minimizing or eliminating the difference in temperature and thermal expansion of the pump rotor 12 and cantilever end section 45. In the shown embodiment, the axial length of the isolation annulus 46 is approximately one-eighth inch and is limited by the need to maintain the structural rigidity of the sleeve 40 around each of the outlet bores 48 through the sleeve 40. Unbroken sealing surfaces are provided along the full length of the cantilever end section 45 and the corresponding section of the distributor rotor 28. Also, the cantilever end section 45 provides over one-half the axial length of the sealing section between the distributor port 56 and the inner axial end of the seal. The radial height of the annulus is approximately one-sixteenth inch. The radial thickness of the cantilever end section 45 is approximately 0.085 inch and is established to provide the desired thermal coupling of the cantilever end section 45 with the distributor rotor 28 during cold starting and pump acceleration and at the same time maintain an acceptable seal between the cantilever end section 45 and the distributor rotor 28.

In previous designs, the inlet port 58 of the distributor bore 52 and the inlet port 64 of the balancing bore 60 were axially spaced from the bank of plunger bores 16 or angularly aligned with and connected directly to the plunger bores 16. In such designs, the hoop stress within the distributor rotor 28 surrounding each inlet port 58, 64 and surrounding the adjacent plunger bore 16 were additive and such that the rotor 28 could be overstressed around the inlet ports 58, 64. The periodic high pressure pulsations eventually resulted in crack initiation, crack propagation and failure of the distributor rotor 28. In accordance with the present invention, the bores 52, 60 are angularly offset, for example, 45° from the plunger bores 16, so that their inlet ports 58, 64 are connected to the high pressure chamber between adjacent plunger bores 16 and largely, if not totally, within the pumping chamber section of the pump body 26 (i.e., between transverse side planes on opposite sides of and tangential to the transverse bank of plunger bores 16). The inlet ports 58, 64 are thereby positioned where the hoop stresses surrounding the adjacent plunger bores 16 partly or fully cancel out each other, thereby reducing the total stress surrounding the inlet ports 58, 64. Also, the inlet ports 58, 64 open into each of the pair of adjacent plunger bores 16 as well as into the peripheral annulus 152 in the poppet valve 10. In the optimum arrangement shown, the inlet ports 58, 64 are located equidistant between the axes of adjacent plunger bores 16. Also, any axial intrusion of the inlet ports in either axial direction from the transverse pumping chamber section is preferably held to a minimum. Any such intrusion toward the valve seat 144 might adversely affect the structural rigidity of the valve seat 144. Any such intrusion in the opposite direction reduces the axial length of the seal between the rotor 12 and the poppet valve 10. The axial length of that seal is limited by the provision of a peripheral bleed annulus 145 and bleed hole in the valve stem 150 which bleeds leakage fuel into the internal coaxial bore 112 within the poppet valve 10. The bleed annulus 145 is axially located inwardly of the inner axial end of the distributor rotor 28 to minimize the internal pressure within the distributor rotor 28 and thus any enlargement of the distributor rotor 28 by that internal pressure.

Figure 8:
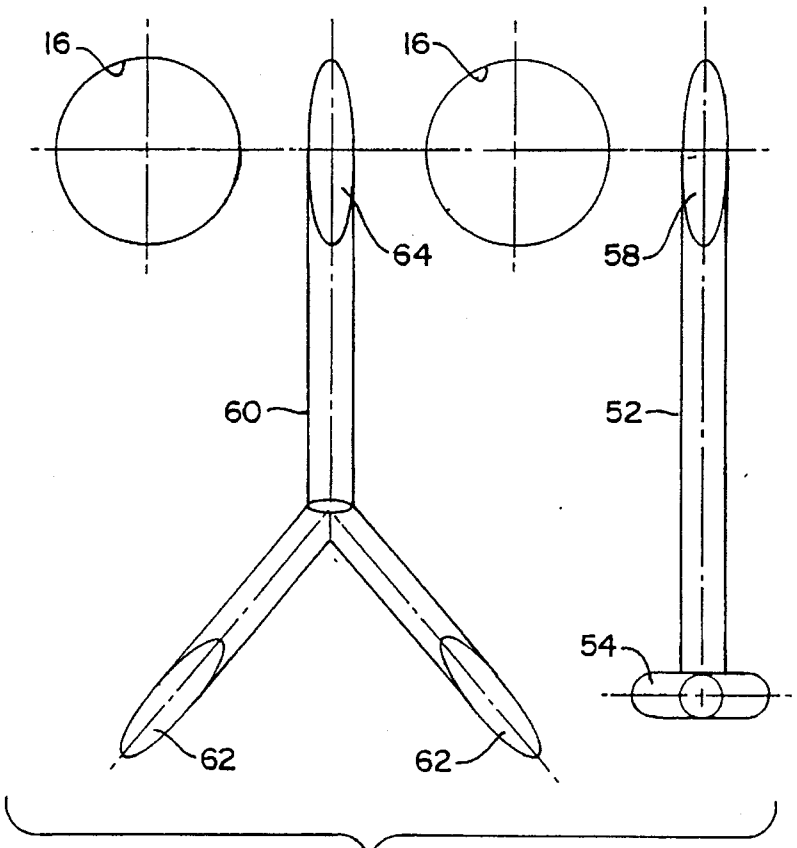
FIG. 8 is an enlarged layout view, like FIG. 7, of a modified fuel injection pump having two diametrically opposed pumping plunger bores.

In a modified embodiment, the pumping chamber 30 is formed by an annular arrangement of two diametrally opposed plunger bores 16 instead of the described four plunger bores 16. In that event, the distributor bore 52 and balancing bore 60 are preferably angularly offset 90° from the axes of the plunger bores 16 as shown in FIG. 8. The inlet ports 58, 64 then open only into the peripheral annulus 152 in the poppet valve 10. Also, the inlet ports 58, 64 are axially located largely, if not totally, within the pumping chamber section as described with respect to the embodiment shown in FIG. 7.

As will be apparent to persons skilled in the art, various modifications, adaptations and variations of the foregoing specific disclosure can be made without departing from the teachings of the present invention.

I claim:

1. A fuel injection pump having a pump rotor providing a pump body and distributor rotor in coaxial alignment, the pump body having a pumping chamber with an annular arrangement of pumping plunger bores with axes extending generally radially outwardly from the axis of the pump rotor; a pumping plunger mounted in each plunger bore; a cam surrounding the pump body for reciprocating the pumping plungers for supplying intake charges of fuel to the pumping chamber and delivering high pressure charges of fuel from the pumping chamber for fuel injection; a drive shaft in coaxial alignment with the pump rotor adjacent to one end of the pump rotor; a distributor head, with an inner rotor support sleeve, having a plurality of distributor outlets; the distributor rotor being rotatably mounted within the rotor support sleeve for distributing high pressure charges of fuel to the distributor outlets; the pump rotor having a central coaxial throughbore providing a valve bore intersecting the plunger bores and an annular valve seat an elongated valve member, mounted in the valve bore, having a sealing head engageable with the annular valve seat and extending from the sealing head toward the opposite end of the pump rotor from the drive shaft, the valve member being axially shiftable in the valve bore in one axial direction to a closed position thereof with the sealing head in engagement with the valve seat and in the opposite axial direction to an open position thereof with the sealing head axially spaced from the valve seat; an electromagnet at said opposite end of the pump rotor, the electromagnet comprising a transverse armature plate fixed to the valve member and a stator, axially spaced in said one axial direction from the armature plate, operable when energized to attract the armature plate to pull the valve member in said one axial direction toward the stator to its closed position; spring means shifting the valve member in the opposite axial direction to its open position when the electromagnet is deenergized; first coupling means coupling the adjacent inner ends of the drive shaft and pump rotor for positive rotation of the pump rotor with the drive shaft; a valve stop axially spaced in said opposite axial direction from the armature plate, the valve stop and armature plate having opposed transverse faces engageable for establishing said open position of the valve member, one of said transverse faces having a plurality of lands engageable by the other transverse face and a plurality of intermediate grooves, the lands and grooves cooperating to produce a hydraulic damping effect on the armature plate as the valve member is axially shifted to its said open position by the spring means, the valve stop comprising second and third coupling means respectively coupling the valve stop to the pump rotor and the armature plate to the valve stop for positive rotation of the armature plate and valve stop with the pump rotor.

2. A fuel injection pump according to claim 1 wherein said lands and grooves cooperate to dampen the armature plate during approximately the last 0.001 inch of armature plate travel before engagement of said opposed transverse faces of the armature plate and the valve stop.

3. A fuel injection pump according to claim 1 wherein the armature plate comprises a plurality of vent holes for venting the gap between said opposed transverse faces of the armature plate and the valve stop.

4. A fuel injection pump according to claim 1 wherein said first coupling means comprises a radial slot in the pump rotor and a radially offset and axially extending pin having a shank press fit into an opening in the drive shaft and a circular head received within the radial slot in the rotor.

5. A fuel injection pump according to claim 1 further comprising a thrust bearing between the pump body and the rotor support sleeve, the thrust bearing comprising a thrust washer engaging the pump body and a needle bearing between the thrust washer and the rotor support sleeve to transmit the axial load on the pump rotor from the pump body through the thrust washer and needle bearing to the rotor support sleeve.

6. A fuel injection pump according to claim 1 wherein the rotor support sleeve has a coaxial isolation annulus at the axial end thereof toward the pump body forming an annular cantilever end section of the sleeve in sealing engagement with a corresponding section of the distributor rotor.

7. A fuel injection pump according to claim 1 wherein the armature plate has a hub and the valve stop has a central opening receiving the hub and wherein the valve stop and hub have cooperating surfaces providing said third coupling means.

8. A fuel injection pump according to claim 7 wherein said second coupling means comprises a plurality of axially inwardly projecting flanges on the valve stop having opposed surfaces engaging cooperating surfaces on the pump rotor to key the valve stop to the pump rotor.

9. A fuel injection pump having a pump rotor providing a pump body and distributor rotor in coaxial alignment, the pump body having a pumping chamber with an annular arrangement of pumping plunger bores with axes extending generally radially outwardly from the axis of the pump rotor; a pumping plunger mounted in each plunger bore; a cam surrounding the pump body for reciprocating the pumping plungers for supplying intake charges of fuel to the pumping chamber and delivering high pressure charges of fuel from the pumping chamber for fuel injection; a drive shaft in coaxial alignment with the pump rotor adjacent to one end of the pump rotor; a distributor head with a rotor support bore and a plurality of distributor outlets; the distributor rotor being rotatably mounted within the rotor support bore for distributing high pressure charges of fuel to the distributor outlets; the pump rotor having a central coaxial throughbore providing a valve bore intersecting the plunger bores and an annular valve seat; an elongated valve member, mounted in the valve bore, having a sealing head engageable with the annular valve seat and extending from the sealing head toward the opposite end of the pump rotor from the drive shaft, the valve member being axially shiftable in the valve bore in one axial direction to a closed position thereof with the sealing head in engagement with the valve seat and in the opposite axial direction to an open position thereof with the sealing head axially spaced from the valve seat; an electromagnet at said opposite end of the pump rotor, the electromagnet comprising a transverse armature plate fixed to the valve member and a stator, axially spaced in said one axial direction from the armature plate, operable when energized to attract the armature plate to pull the valve member in said one axial direction toward the stator to its closed position; spring means shifting the valve member in the opposite axial direction to its open position when the electromagnet is deenergized; a transverse end plate axially spaced in said opposite axial direction from the armature plate, the armature plate and the end plate having opposed transverse surfaces in face to face engagement in said open position of the valve member, at least one of said opposed transverse surfaces having a plurality of lands engageable by the other transverse surface and intermediate grooves between said lands to conduct fuel from between the opposed transverse surfaces as the valve member is shifted by the spring means to its said open position.

10. A fuel injection pump according to claim 9 wherein the transverse end plate has said one transverse surface with said lands and grooves.

11. A fuel injection pump having a pump rotor providing a pump body and distributor rotor in coaxial alignment, the pump body having a pumping chamber with an annular arrangement of pumping plunger bores with axes extending generally radially outwardly from the axis of the pump rotor; a pumping plunger mounted in each plunger bore; an annular cam surrounding the pump body for reciprocating the pumping plungers for supplying intake charges of fuel to the pumping chamber and delivering high pressure charges of fuel from the pumping chamber for fuel injection; a drive shaft in coaxial alignment with the pump rotor adjacent to the pump rotor, the drive shaft having an enlarged inner annular end surrounding the pump body and having an annular arrangement of radial slots in radial alignment with the pumping plunger bores respectively, a roller shoe mounted in each slot for engagement with the respective pumping plunger, a roller mounted on each roller shoe for engagement with the annular cam for reciprocating the pumping plungers; a distributor head with a rotor support bore and a plurality of distributor outlets; the distributor rotor being rotatably mounted within the rotor support bore for distributing high pressure charges of fuel to the distributor outlets; the pump rotor having a central coaxial throughbore providing a valve bore intersecting the plunger bores and an annular valve seat at one end of the valve bore; an elongated valve member, mounted in the valve bore, having a sealing head at one end thereof engageable with the annular valve seat and extending from the sealing head toward the other end of the valve bore, the valve member being axially shiftable in the valve bore between a closed position thereof with the sealing head in engagement with the valve seat and an open position thereof with the sealing head axially spaced from the valve seat; an electromagnet at the opposite end of the valve member from the sealing head, operable when energized to actuate the valve member in one axial direction to one of its positions; spring means shifting the valve member in the opposite axial direction to its other position when the electromagnet is deenergized; the pump rotor and drive shaft having opposed inner end faces with a radial slot in the inner end face of the pump rotor and a radially offset and axially extending opening in the inner end face of the drive shaft, and a pin having a shank press fit into said opening in the inner end face of the drive shaft and a circular head received with the radial slot in the rotor for coupling the pump rotor to the drive shaft.

12. A fuel injection pump having a pump rotor providing a pump body and distributor rotor in coaxial alignment, the pump body having a pumping chamber with an annular arrangement of pumping plunger bores with axes extending generally radially outwardly from the axis of the pump rotor; a pumping plunger mounted in each plunger bore; a cam surrounding the pump body for reciprocating the pumping plungers for supplying intake charges of fuel to the pumping chamber and delivering high pressure charges of fuel from the pumping chamber for fuel injection; a drive shaft in coaxial alignment with the pump rotor adjacent to the pump rotor; a distributor head having a plurality of distributor outlets; the distributor rotor being rotatably mounted within the distributor head for distributing high pressure charges of fuel to the distributor outlets; the pump rotor having a central coaxial throughbore providing a valve bore intersecting the plunger bores and an annular valve seat at one end of the valve bore; an elongated valve member, mounted in the valve bore, having a sealing head at one end thereof engageable with the annular valve seat and extending from the sealing head toward the other end of the valve bore, the valve member being axially shiftable in the valve bore between a closed position thereof with the sealing head in engagement with the valve seat and an open position thereof with the sealing head axially spaced from the valve seat; an electromagnet at the opposite end of the valve member from the sealing head, the electromagnet comprising an armature fixed to said opposite end of the valve member and a stator axially spaced from the valve member and operable when energized to attract the armature to pull the valve member in one axial direction toward the stator to one of its said positions; spring means shifting the valve member in the opposite axial direction to its other position when the electromagnet is deenergized; a valve stop mounted on the end of the pump rotor between the pump rotor and the armature and engageable by the armature to establish said other position of the valve member when the electromagnet is deenergized; the armature having an inner hub and the valve stop having a central opening receiving the inner hub, the valve stop and inner hub having cooperating surfaces keying the armature to the valve stop, and the valve stop and pump rotor having cooperating means keying the valve stop to the pump rotor.

* * * * *

UNITED STATES PATENT AND TRADEMARK OFFICE

CERTIFICATE OF CORRECTION

PATENT NO. : 5,540,564
DATED : July 30, 1996
INVENTOR(S) : Kenneth H. Klopfer

It is certified that error appears in the above-indentified patent and that said Letters Patent is hereby corrected as shown below:

Column 7, line 47, after "seat" insert --;--.

Signed and Sealed this

Nineteenth Day of November, 1996

Bruce Lehman

*Attest:*

BRUCE LEHMAN

*Attesting Officer*

*Commissioner of Patents and Trademarks*